US005152214A

United States Patent [19]

Nordberg

[11] Patent Number: 5,152,214

[45] Date of Patent: Oct. 6, 1992

[54] TIRE COMPACTING MACHINE

[76] Inventor: Henry T. Nordberg, 510 Lake Rd., Oneida, N.Y. 13421

[21] Appl. No.: 774,577

[22] Filed: Oct. 10, 1991

[51] Int. Cl.[5] ..... B65B 27/06

[52] U.S. Cl. ..... 100/12; 100/48; 100/264; 100/269 R

[58] Field of Search ..... 100/3, 12, 8, 244, 264, 100/43, 48, 269 R; 92/117 A

[56] References Cited

U.S. PATENT DOCUMENTS

| | | | |
|---|---|---|---|
| 2,404,639 | 7/1946 | Lane | 92/117 A |
| 2,920,555 | 1/1960 | Sherriff | 100/12 |
| 2,921,423 | 1/1960 | Cover | 100/12 |
| 3,129,658 | 4/1964 | Valente . | |
| 3,195,444 | 7/1965 | McClean . | |
| 3,212,429 | 10/1965 | Fay . | |
| 3,400,652 | 9/1968 | Hill | 100/12 |
| 3,675,569 | 7/1972 | Moor | 100/12 |
| 3,705,658 | 12/1972 | Harris . | |
| 3,802,337 | 4/1974 | St. Hilaire . | |
| 3,822,579 | 7/1974 | Kononenko | 100/264 |
| 3,831,511 | 8/1974 | Back | 100/264 |
| 3,955,491 | 5/1976 | McMahon . | |
| 3,974,761 | 8/1976 | Hill | 100/12 |
| 4,024,805 | 5/1977 | Glasson | 100/12 |
| 4,141,396 | 2/1979 | McCallister . | |
| 4,155,300 | 5/1979 | Baltschun . | |
| 4,222,323 | 9/1980 | Martindale | 100/12 |
| 4,306,826 | 12/1981 | Detwiler . | |
| 4,683,020 | 7/1987 | Portalupi et al. . | |
| 4,732,331 | 3/1988 | Hughes . | |
| 4,771,686 | 9/1988 | Triantos, Jr. . | |
| 4,793,124 | 12/1988 | Anderson . | |
| 4,805,507 | 2/1989 | Schmidt et al. . | |
| 4,807,321 | 2/1989 | Grasselli | 92/117 A |
| 4,872,360 | 10/1989 | Lew | 92/117 A |
| 5,056,428 | 10/1991 | Allen | 100/269 R |
| 5,088,394 | 2/1992 | Bertrand | 100/12 |
| 5,615,366 | 10/1986 | Scarbrough, Jr. . | |

FOREIGN PATENT DOCUMENTS

| | | | |
|---|---|---|---|
| 1049294 | 1/1959 | Fed. Rep. of Germany | 100/3 |
| 0002898 | 1/1979 | Japan | 100/12 |
| 0853209 | 8/1981 | U.S.S.R. | 92/117 A |

OTHER PUBLICATIONS

*Primary Examiner*—Philip R. Coe
*Assistant Examiner*—Randall Edward Chin
*Attorney, Agent, or Firm*—Wall and Roehrig

[57] ABSTRACT

A tire compacting machine has a pair of compactor plates mounted on hydraulic cylinders formed around the tie bars of the frame to move the compactor plates from the ends of the machine toward the center of the machine to compact therebetween a number of tires positioned about a mandrel hinged to one of the compactor plates. The tires are positioned in the machine about the mandrel and are captured between the compactor plates about the mandrel as the plates are moved together to compress the tires into a dense compacted uniform cross section bundle for efficient storage, handling and/or disposal. The machine can compact a wide range of numbers of tires from a few to twenty or so and the degree of compaction can be varied to suit the application, i.e., usable tires compacted slightly, unusable tires tightly compacted. The mandrel is pivotally mounted on one compactor plate and slidably received in an aperture in the other compactor plate so that tires are completely contained during the compaction cycle.

13 Claims, 6 Drawing Sheets

TIRE COMPACTING MACHINE

BACKGROUND OF THE INVENTION

This invention relates to apparatus for compacting a number of low density annular objects into a single dense bundle for efficient storage and handling. More particularly, this invention relates to an apparatus for compacting a number of vehicle tires into a dense compressed bundle for easy storage and handling.

In recent years the problem of recycling or otherwise disposing of unusable automobile tires has become an increasing problem. With increased emphasis on the environment and recycling of environmentally detrimental materials, it is no longer possible to merely burn or bury the millions of automobile tires discarded each year in the United States. The automobile tire, by the nature of its size and shape, occupies a particularly large volume of space, particularly compared to its weight, and in addition, presents a very awkward article to handle in large numbers. In my co-pending application, Ser. No. 651,956 filed Feb. 7, 1991, there is disclosed an apparatus for compacting a quantity of twenty automobile tires into a compressed bundle occupying the space of three or four uncompacted tires. This compacted bundle of tires can be handled with much greater efficiency from both a storage and shipping standpoint. In this apparatus, as in most of the prior art devices, a quantity of tires has been lined up on an elongated base between a compactor plate fixed at one end of the apparatus and a movable compactor plate connected to the end of a piston rod of a hydraulic cylinder mounted at the other end of the apparatus. Upon actuation of the cylinder, the movable compactor plate is moved axially toward the fixed compactor plate to compress and compact the tires positioned therebetween. At the end of the desired compaction, banding or wire straps are placed around the compacted bundle, the hydraulic cylinder is retracted, and the compressed bundle removed.

While the machine shown in my prior referenced application has proven quite satisfactory for certain applications, the length of the machine and the need for a firm supporting foundation for proper operation of the machine have imposed certain limitations on the device as shown in the aforesaid application.

OBJECTS AND SUMMARY OF THE INVENTION

It is accordingly an object of the present invention to overcome the limitations of the prior art.

It is another object of the present invention to provide a tire compacting apparatus having a substantially shorter machine length for a given tire capacity than heretofore available.

It is another object of the present invention to provide a tire compactor apparatus that can be cycled in a much shorter time than heretofore possible.

It is another object of the present invention to provide a tire compacting apparatus having improved safety of operation over the prior art.

It is another object of the present invention to provide a tire compacting machine that can be simply and easily transported on a standard length truck over the road from site to site to provide a mobile compaction capability.

It is another object of the present invention to provide a tire compacting machine construction that provides superior machine rigidity and safety during the tire compaction process.

It is another object of the present invention to provide a tire compaction machine that can be operated at lower hydraulic pressure and reduced cycle times over the prior art.

It is another object of the present invention to provide a tire compacting apparatus which is simple and economical to construct, rigid enough to be used on uneven support bases, and readily transported from site to site for field compaction of quantities of tires.

These and other objects are attained in accordance with the present invention wherein there is provided a frame structure having a pair of compactor plates movable one from each end thereof toward the center with the hydraulic cylinders for moving each compactor plate being constructed integrally with the support structure forming the frame of the machine eliminating overextended piston rods and hydraulic cylinders and reducing operating pressures required for a given compaction load, all while decreasing the cycle time of operation for greater throughput of compacted tires.

BRIEF DESCRIPTION OF THE DRAWINGS

For a better understanding of these and other objects of the present invention, reference is made to the detailed description of the invention which is to be read in conjunction with the following drawings, wherein.

DETAILED DESCRIPTION OF A PREFERRED EMBODIMENT

Figure 1:
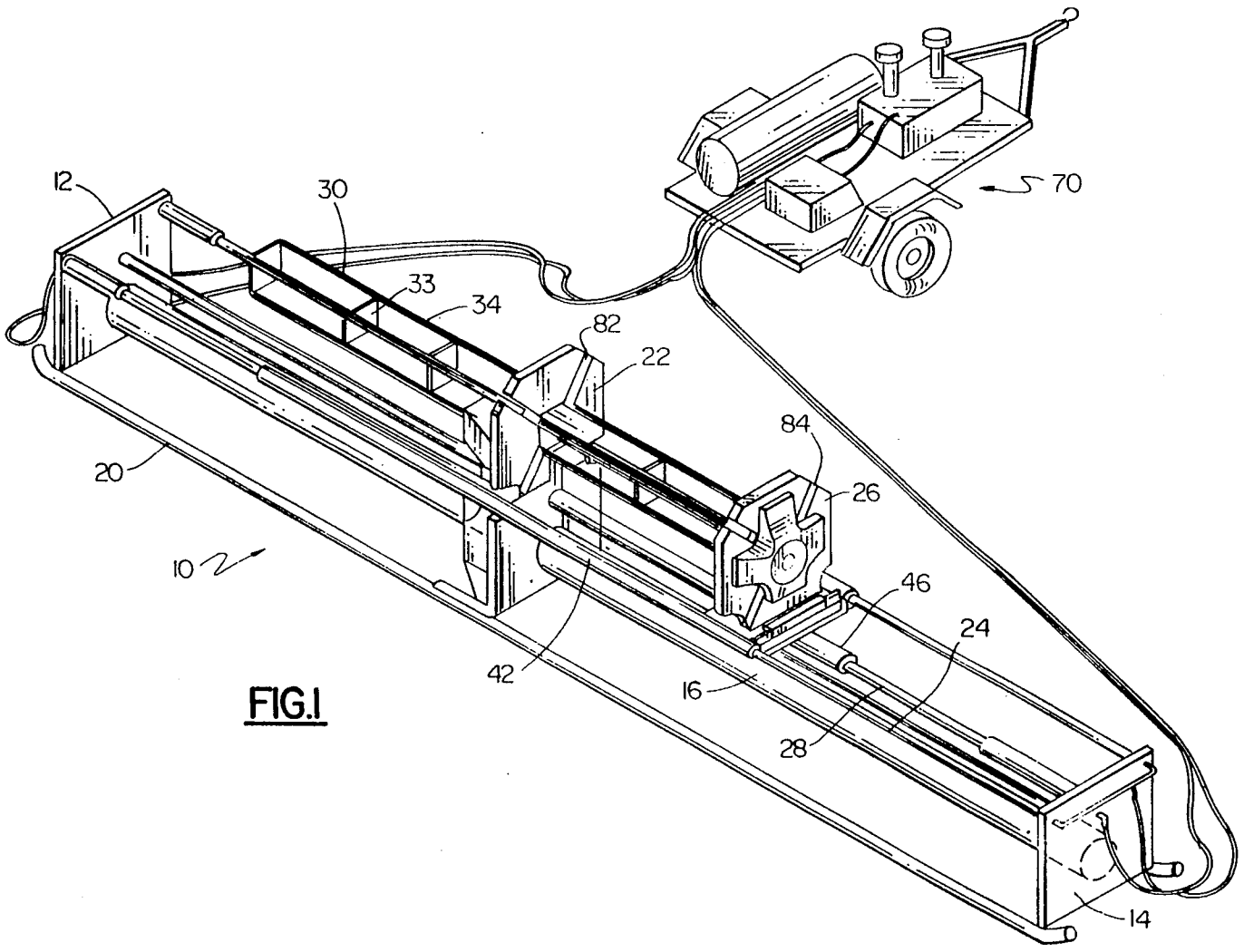
FIG. 1 is a perspective view of a machine in accordance with the present invention.

Referring now to FIG. 1, the tire compacting machine 10 according to the present invention has a pair of end frame members 12 and 14 joined together by a large structural tube member 16 and a pair of small diameter tube members 20 at each lower corner thereof. These members are secured to the end plates by welding or otherwise and carry thereon a first movable compactor plate 22, shown on the left-hand side of FIGS. 1–4.

A pair of tubular tie bars 24 are positioned adjacent the upper corners of the frame members 12 and 14. These tie bars 24 double as the hydraulic cylinders for carrying thereon a second movable compactor plate 26, as will be described in more detail herein. A third tubular tie bar 28 is positioned above the large structural tube member 16. Tube 28 also doubles as the core of the hydraulic cylinder for moving the right-hand compactor plate 26, as will be described in more detail herein.

Figure 2:
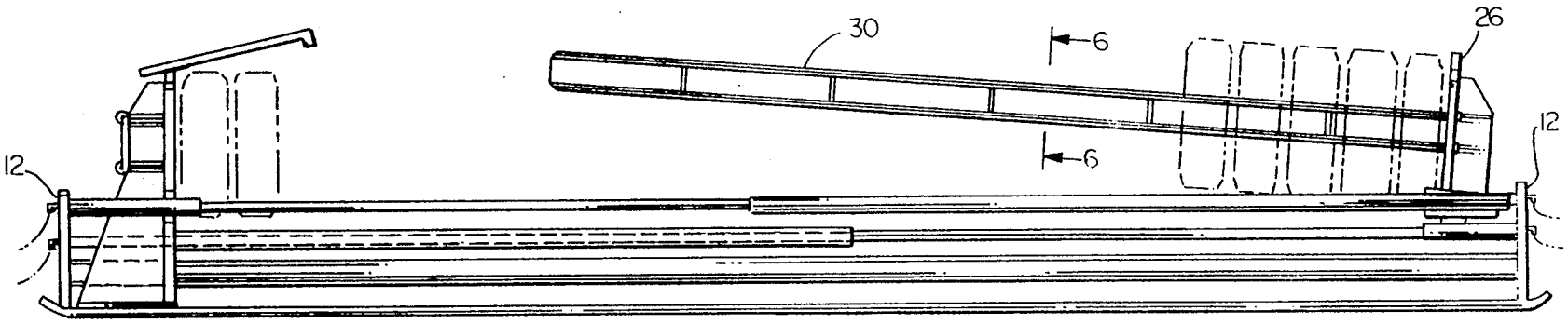
FIG. 2 is a side elevation of the machine in the open position preparatory to loading.
Figure 3:
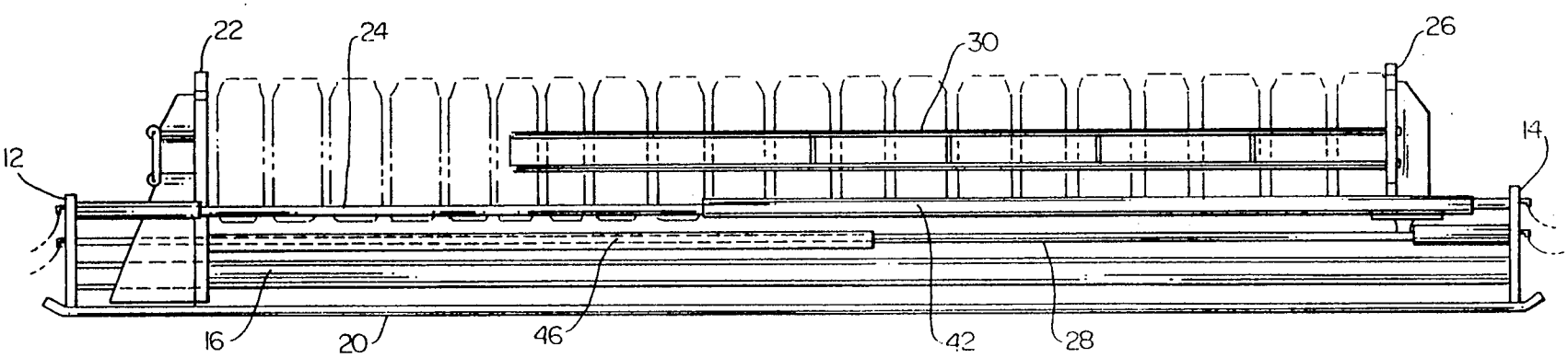
FIG. 3 is a side elevation similar to FIG. 2 showing the start of the compaction cycle.
Figure 6:
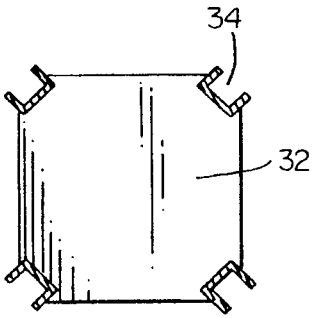
FIG. 6 is a cross-sectional view on line 6—6 of FIG. 2.

A mandrel 30 is pivotally mounted on the right-hand movable compactor plate 26 so that in the fully retracted position all the way to the right hand end of FIG. 2, it will be tilted upwardly at an acute angle to the tube 16. Except for this extreme right hand position, mandrel 30 is supported in a generally horizontal position parallel to the longitudinal axis of the machine frame. Mandrel 30 has a cross-section as shown in FIG. 6 and is formed from a series of six square plates 32 notched at the corners to receive channels 34. The plates 32 and channels 34 are assembled together and welded or otherwise secured as may be seen in the drawings. Movable compactor plate 22 has an aperture 36 therein which has a shape corresponding to the cross-sectional shape of the mandrel 30. Compactor plate 2 carries four roller bearing members 38 mounted to track in the channels 34 in the mandrel 30 during the compaction process. The mandrel 20 is somewhat shorter than the overall compaction capacity of the machine, but it rapidly enters through the center of the tires to be compacted and aperture 36 before any significant compaction has taken place so as to support and align the row of tires to be compacted during the compaction process. The diameter of the mandrel is chosen to provide significant alignment support, but is less than the diameter of the tires to be compacted, so they may easily be loaded on the mandrel for compaction.

In operation, the machine is fully opened by moving the movable compaction plates 22 and 26 to the fully retracted position abutting their respective end plates 12 and 14, as shown in FIG. 2. In this position, the mandrel 30 is tilted at an acute angle to facilitate the loading of tires thereon. Tires to be compacted will be placed over the mandrel and allowed to slide to the right in FIG. 2 assisted by gravity until the mandrel is fully loaded. The mandrel has a length sufficient to accept some 15 or 16 tires, and the balance are placed on tie bars 24 leaning against the movable compactor plate 22 on the left in FIGS. 2 and 3.

Figure 4:
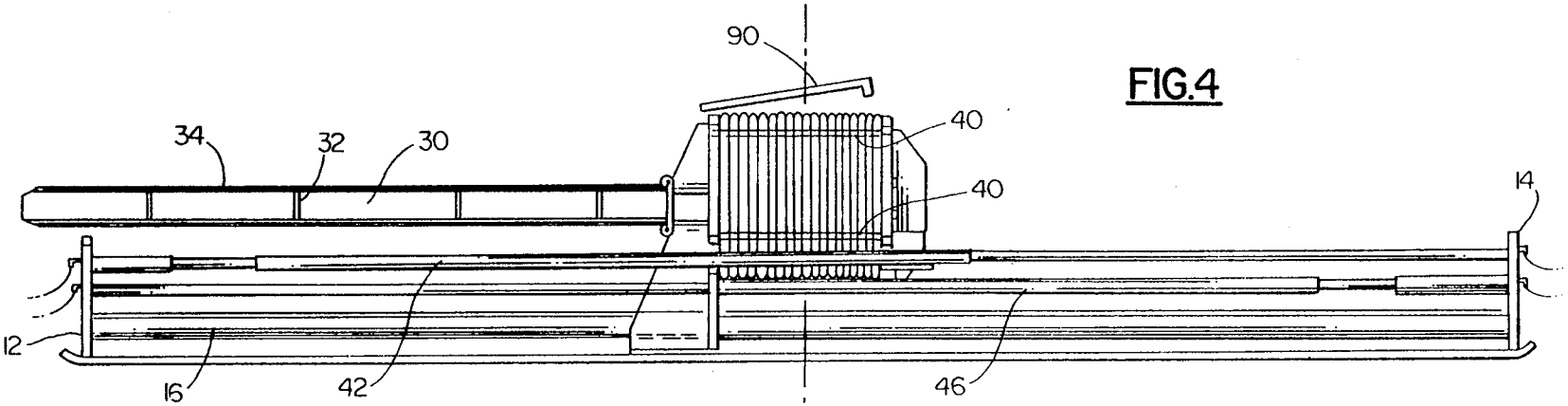
FIG. 4 is a side elevation showing twenty tires in the fully compacted condition.
Figure 5:
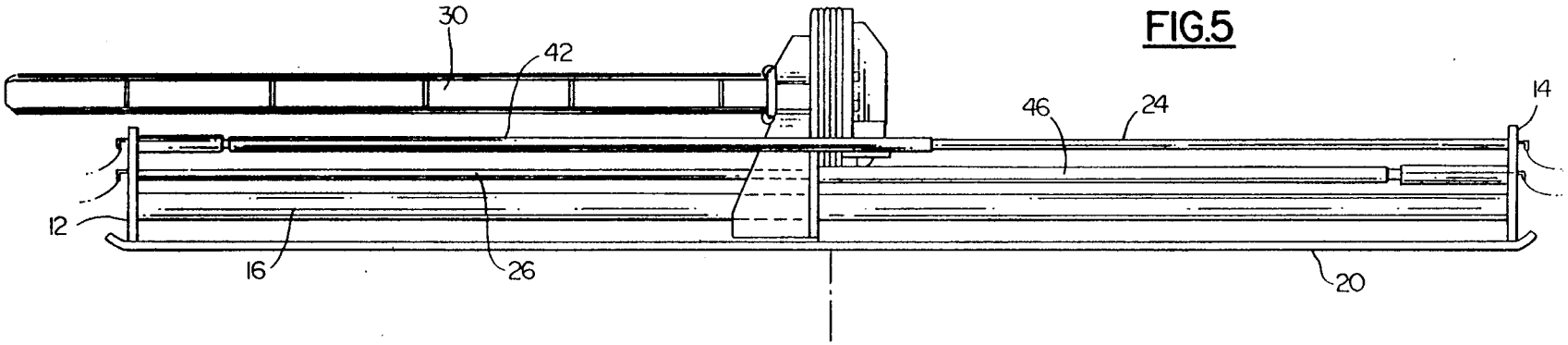
FIG. 5 is a side elevation similar to FIG. 4 showing a small quantity of five tires compacted to a miniature bundle.

As will be described in detail herein, within the first two inches of movement of the compactor plate 26 toward plate 22, the mandrel 30 is dropped down into the horizontal position so that it will align with the center of the tires on the left-hand side and will move through those tires into the recess 36 in compactor plate 22. Compactor plate 2 not only acts as one of the compacting plates, but it also acts as an alignment fixture for the mandrel 30 locking the compactor plates 22 and 26 together and aligning the tires to be compacted so that as they are compacted, a uniform bundle is formed (FIG. 4). The tires cannot be squeezed out of line and caused to deform or otherwise produce an offset bundle.

The compactor plates 22 and 26 are moved toward each other and the center of the compaction machine by their respective hydraulic cylinders until the desired length of bundle is achieved. By setting limit switches or by sensing the hydraulic pressure, the length of the compacted bundle can be controlled to a desired dimension. Typically, a quantity of twenty tires will be compacted to an overall length of approximately twenty inches. This is accomplished by closing the two compactor plates 22 and 26 together about the center of the machine to a spacing something less than twenty inches and placing the appropriate sized tie wires 40 through the four channels 34 and locking them together about the bundle. When the pressure is released, the overall bundle length is approximately twenty inches as held by four bands 40.

In the embodiment shown in FIGS. 1–4, the overall machine has a length of fourteen feet and the compaction distance between the movable compactor plates in the fully open position is twelve feet and the mandrel shown has a length of nine feet. Fully compacted bundles can range from approximately six inches up to the twenty inch bundle indicated above. Partially compacted bundles of any length less than twelve feet can be readily obtained. As can be seen from the foregoing, except for the first three feet, which is basically compressing air, the tires to be compacted are fully captured between the compactor plates 22 and 26 about the mandrel 30 and cannot be ejected outwardly to in any way endanger the operator of the device, or to produce non-uniform humpback bundles as has heretofore been encountered in prior art devices. Another advantage of the present machine is a significantly reduced cycle time and cylinder pressure. Since both compactor plates are moving, the cycle time has been decreased some 35 to 40 percent over that of a machine having one fixed and one movable compactor plate. This has substantially increased the throughput of compacted bundles per machine. Cylinder size and operating pressure have similarly been cut in half.

Figure 7:
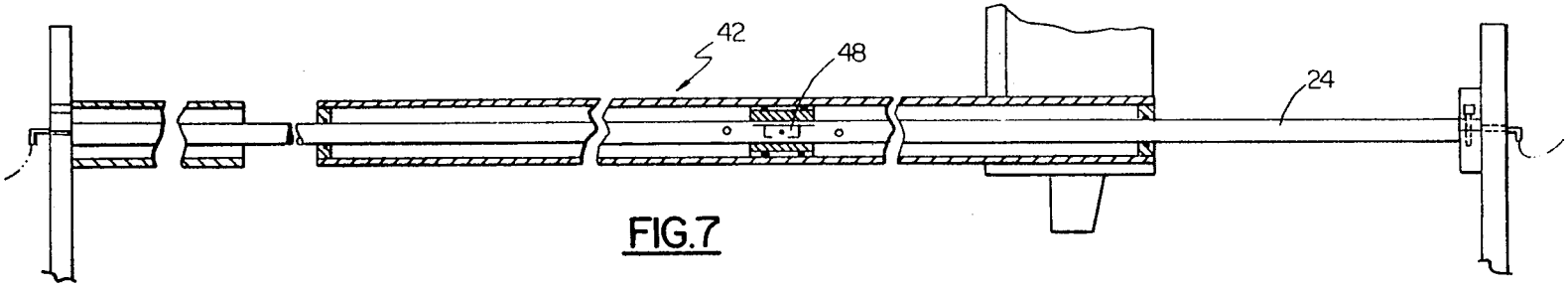
FIG. 7 is a longitudinal cross-section of a hydraulic cylinder in accordance with the present invention.
Figure 8:
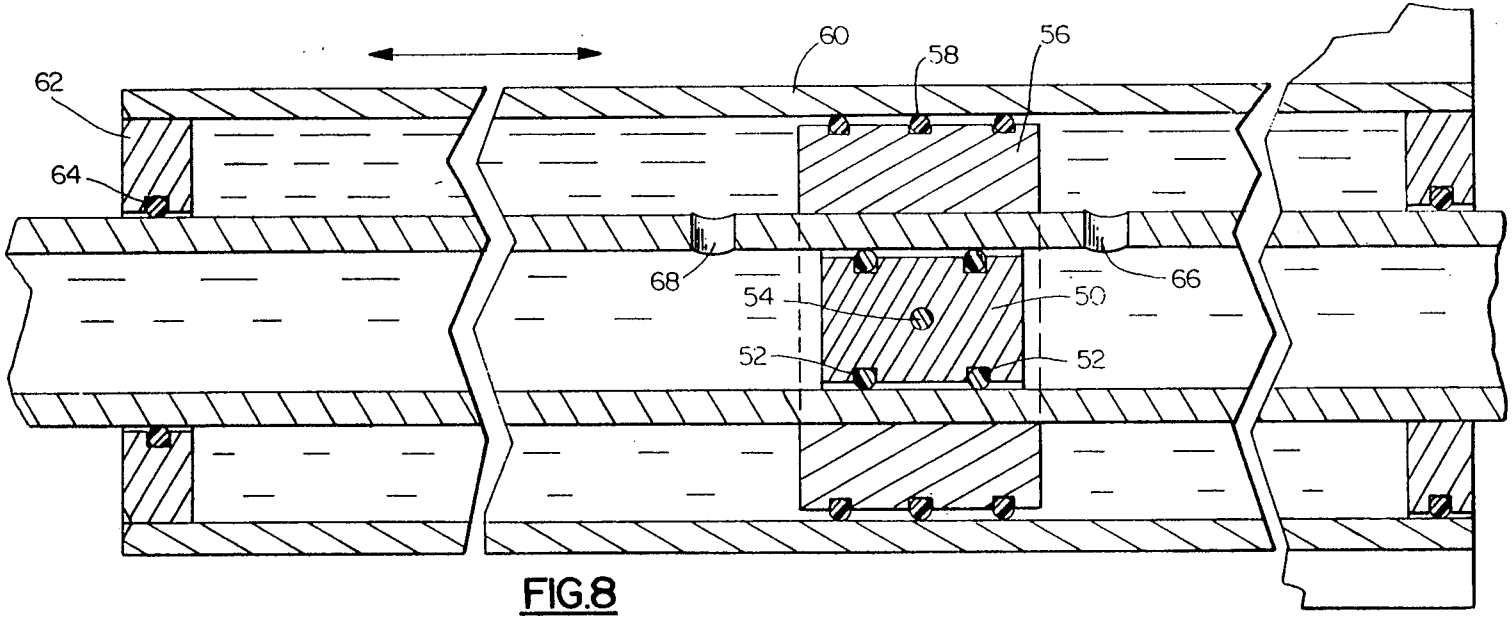
FIG. 8 is a fragmentary cross sectional view on an enlarged scale of the cylinder of FIG. 7.

Referring now to FIGS. 7 and 8, there is shown in longitudinal cross-section the hydraulic cylinder 42 which is typical of the three cylinders 42, 44 and 46 formed about the tie bars 24 or 28 to move the compactor plates 22 and 26 from the retracted to the center compacted position and back. As indicated above, the bars 24 and 28 are hollow tubes and the interior of the bars 24 nd 28 are connected at each end to the hydraulic system as shown in FIG. 1. At the center of the bar 24 is a plug 48 which, as may be seen in FIG. 8, is an annular metal ring 50 with the usual gland seals 52 formed at each side to seal the interior of the tube against passage of hydraulic fluid therethrough from either direction. The plug 48 is pinned in the tube 24 by a pin 54 at the center thereof and allows the interior of the tie bars 24 and 28 to function as hydraulic fluid ducts. A hollow sleeve 60 is mounted about the center of tie bars 24 and 28 and becomes the movable element of hydraulic cylinders 42, 44 and 46. Also fixed about the center of the tube 24 is another annular ring 56 which has sealing glands 58 which allow movement of the outer sleeve 60 relative to ring 56, but prevents passage of hydraulic fluid past the ring 56. As can be seen in FIG. 8, the ends of the sleeve 60 are closed by end caps 62 and seal 64 to form with the sleeve 60 a dual chamber hydraulic cylinder 42 which then becomes with identical cylinder 44 the prime mover for compactor plate 26 to move back and forth relative to end plate 14 and the center of the machine. Hydraulic fluid is introduced, through the holes 66 in bar 24 on the right hand side of FIG. 8 to cause the sleeve 60 to move to the right in FIG. 8 until it hits the end 14 of the machine or an appropriate stop on the hollow tie bar 24. Conversely, if hydraulic fluid is introduced through the hole 68 on the left hand side of ring 56 in FIG. 8, sleeve 60 will be moved the opposite way until stopped at the center of the machine. The movable compactor plate 26, is mounted on the sleeve 60 of cylinders 42 and 44 and carried therewith in the directions as just indicated. As can be seen in FIG. 1, the hollow tubes 24 and 28 are connected to a hydraulic fluid source 70 which with suitable valves and sensors as is well known in the art controls the application of hydraulic fluid to the hydraulic cylinders 42, 44 and 46 on which the compactor plates are mounted. This construction and the hollow tubes 24 and 28 eliminate the need for moving hydraulic hoses and provides a much more efficient apparatus for moving the compactor plates 22 and 26 to compact tires placed therebetween.

Figure 10:
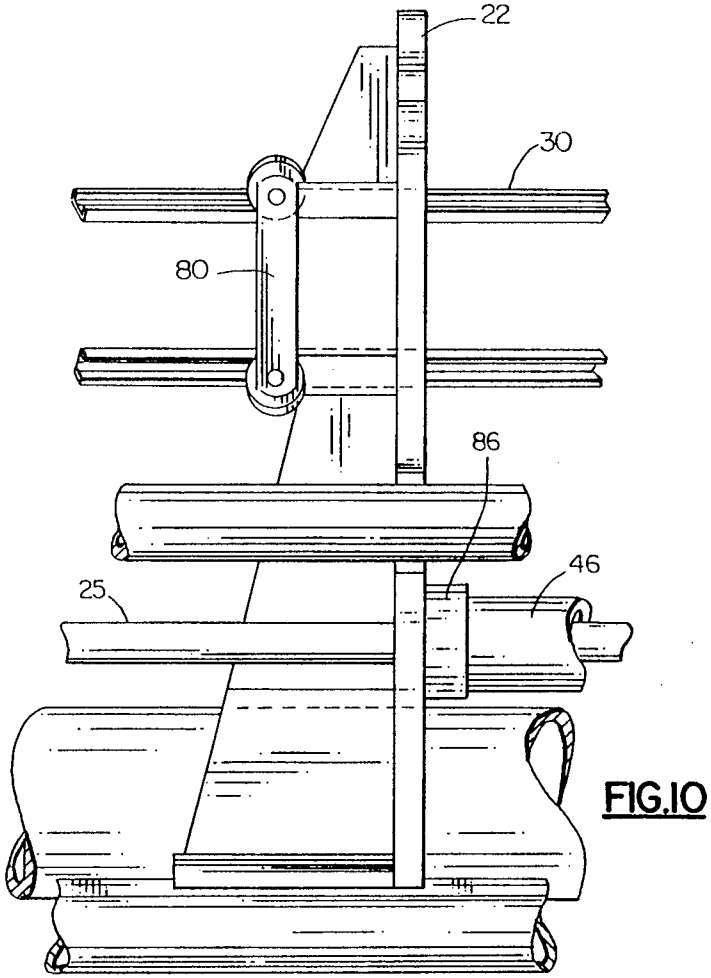
FIG. 10 is a side elevation of the left hand compactor plate of FIGS. 1 and 2.
Figure 9:
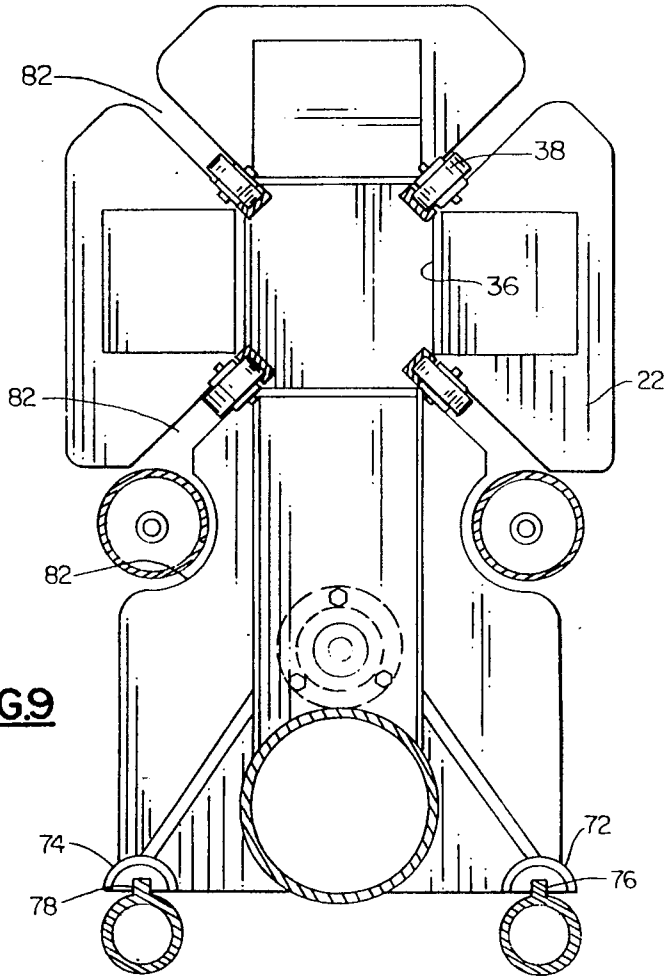
FIG. 9 is an end elevation of the left hand end compactor plate of FIGS. 1 and 2.

Referring now to FIGS. 9 and 10, the details of the mounting of the compactor plate 22 are shown. A indicated above, the compactor plate 22 is mounted for movement along the tube 16 steadied on the two tube members 20 by a pair of feet 72 and 74, which engage about the rails 76 and 78 fixed on the top of tubes 20. Suitable low friction shoes of brass or other material are provided in the feet 72 and 74. Plate 22 is thus prevented from rotating about tube 16 as the plate 26 is moved back and forth on the machine. This provides a very strong steady mounting for the plate 27 which also has formed therein the aperture 36 for receiving the mandrel 30 after the start of compaction of the tires. The opening 36 is basically a square opening slightly larger in size than the circumference of the mandrel as shown in FIG. 6. The roller bearing members 38 are secured in frame 80 at the corners of the square, FIG. 10, for aligning the mandrel 30 within the plate 22. The rollers 38 ride within the channels 34 in the mandrel 30 and thus secure and guide the mandrel through the plate 22 as the two compactor plates 22 and 26 are brought together by the hydraulic cylinders as described in connection with FIGS. 7 and 8. Four radial slots 82 are formed in the plate 22. Corresponding slots 84 are formed in the plate 26 so as to cooperate with the slots 82 in the banding operation as will be described in more detail herein.

The plate 22 is moved back and forth along the cylinder 16 by the hydraulic cylinder 46 formed about the hollow rod 28 in a manner similar to that shown in FIGS. 7 and 8 for cylinder 42. Cylinder 46 is secured to the plate 22 by a collar 86 so as to be able to move the plate along the frame when hydraulic fluid is applied through the hollow tube 28 to one side or the other of a piston corresponding to piston 56 (FIG. 8) fixed at the center of the bar 28, all in a similar fashion to that shown in FIGS. 7 and 8. Clearance slots 88 are formed in plate 22 for tie bars 24 and cylinders 42 and 44 so that the compactor plate 26 mounted on cylinders 42 and 44 can ride therealong as the compactor plates 22 and 24 are brought into compacting relationship for compressing a quantity of tires therebetween.

When the bundle of tires has been fully compacted as shown in FIG. 4, a banding wire or strap 40 is inserted through the slots 82 and 84 and the grooves 34 in the corners of the mandrel so as to extend through the center of the tires. The ends of the straps 40 are then connected together around the outside of the tires to form the bundle. This is all explained in detail in my aforementioned co-pending paten application and is not shown in detail herein. Once the bands are applied about the compacted bundle of tires, the hydraulic pressure to the cylinders 42, 44, and 46 is reversed and the compactor plates are retracted to their rest position adjacent the end plates 12 and 14 of the machine.

A stripper arm 90 is pivotally mounted on the plate 22 so that as the compactor plates 22 and 26 start their return motion toward the end plates 12 and 14, it will fall down over the bundle and hook the right-hand edge of the bundle in FIG. 4 and will then pull it back with the plate 22 to the retracted left hand position. At this point the mandrel 30 has been withdrawn from within the compacted bundle and the bundle will be free to be picked up and moved for further processing or storage. Also, it should be noted that the compacted bundle will have been removed from the mandrel 30 before the mandrel is cammed to its elevated position as shown in FIG. 2. The compacted bundle will rest on the bars 24 at the left-hand end of FIG. 3 in place of the three or four uncompacted tires shown in FIG. 3.

Figure 12:
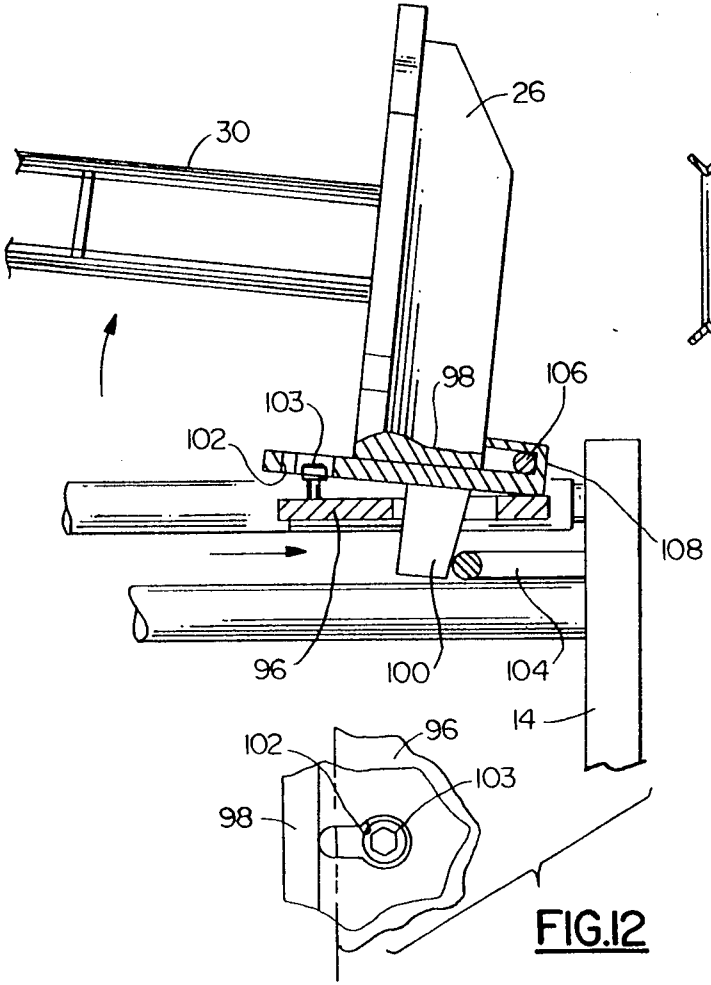
FIGS. 11 and 12 are partial sectional views of the right hand compactor plate of FIG. 1 and 2 showing the mandrel tilting mechanism.
Figure 11:
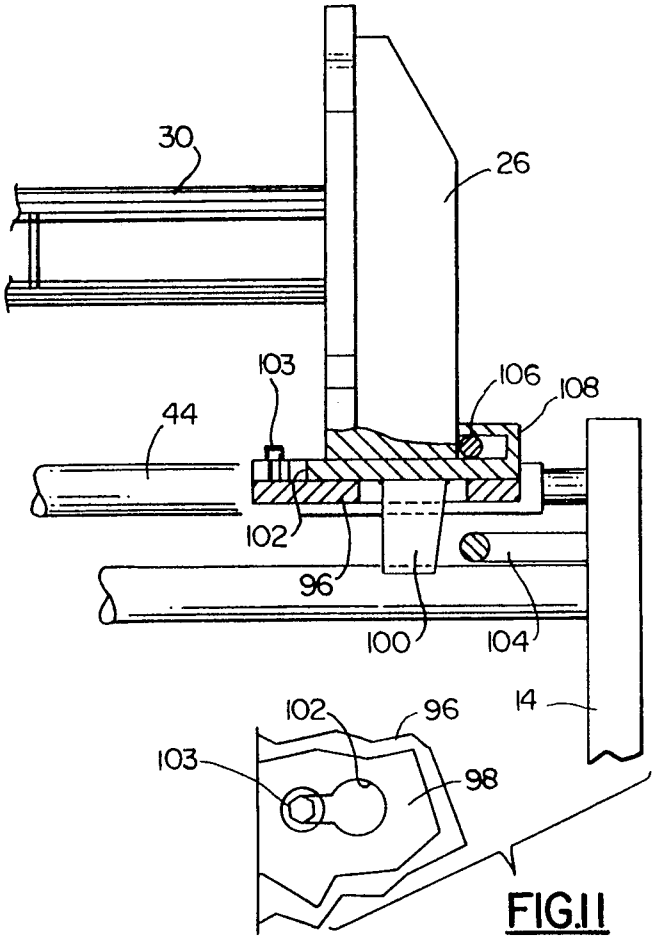

Referring now to FIGS. 11 and 12, there is shown a camming mechanism for elevating the mandrel 30 to the loading position of FIG. 2. A bridge member 96 is fixed at its ends to the hydraulic cylinders 42 and 44 respectively. Compactor plate 26 is fixed on base plate 98 which is pivotally and slidably mounted on bridge member 96. Base plate 98 carries a cam 100 on the bottom which extends through a slot in bridge 96. The inner end of plate 98 has a key hole slot 102 which cooperates with shoulder bolt 103 mounted on bridge plate 96 to secure plate 98 in the FIG. 11 position and release it in the FIG. 12 position for elevation. Essentially the compactor plate 22 is mounted so it can slide longitudinally on the bridge plate 96 and is spring urged into the position shown in FIG. 11. As the compactor plate 26 approaches the end plate 14 of the machine, a stop 104 engages cam 100 extending downwardly from the bottom of the base plate 98 through a slot in the bridge plate 96. This causes the compactor plate 26 to move slightly to the left in FIG. 11 relative to the bridge plate 96, as bridge plate 96 continues to move to its extreme right-hand position with the cylinders 42 and 44. A suitable key slot is provided in the bridge plate 96 to allow for this motion. As the base plate 98 and the compactor plate 26 move to the left in FIGS. 11 and 12, the shoulder bolt 103 which has been engaged about the plate 98 clears the edge of the slot 102. At the same time, inverted hook 108 engages rod 106 and allows the plate to be pivoted about rod 106 to the position shown in FIG. 12. The rod 106 is mounted on the bridge plate 96 at the outboard edges thereof and is held in a fixed position to act as a hinge member for the base plate 98 when cammed to the upper position shown in FIG. 12. This provides a simple, rugged and fool-proof method for allowing the mandrel 30 to be tilted upwardly for the loading of the tires in the mechanism. It should be noted that a short movement of an inch or so of the cam 100 will translate into ten to twelve inches of movement of the outboard free end of the mandrel 30 to elevate it sufficiently to assist in the loading of tires into the machine.

Similarly, after the mandrel 30 has been loaded with tires and additional tires placed in the space between the end of the mandrel and compactor plate 22, movement to the left in FIGS. 1 and 12 of hydraulic cylinders 42 and 44 will allow base plate 98 to drop back to the horizontal position within the first inch or two of travel. The free end of mandrel 30 will thus drop down into alignment with the center of the additional tires on the tie bars 24 before reaching them in the compaction cycle. Further movement of about 18 inches each of compactor plates 22 and 26 will cause the mandrel 30 to enter the aperture 36 in plate 22 to "lock up" the apparatus for compaction of tires.

I have thus provided an improved tire compacting apparatus that is safer to use, faster to operate, more economical to manufacture and more readily transported to accumulated tire sites.

While this invention has been explained with reference to the structure disclosed herein, it is not confined to the details set forth and this application is intended to cover any modifications and changes as may come within the scope of the following claims:

What is claimed is:

1. A machine for compressing and compacting a number of vehicle tires into a single dense bundle for efficient storage and handling which comprises, in combination:

an elongated frame member having a plurality of longitudinal tie bar members joining a pair of end frame plates;

a first compactor plate assembly slidably mounted on at least one of said tie bar members for movement from one end frame plate toward the middle of said frame member;

a second compactor plate assembly slidably mounted on at least one other tie bar member for movement from the other end frame plate toward the middle of said frame member;

first hydraulic cylinder means connected between said first compactor plate assembly and said elongated frame member;

second hydraulic cylinder means connected between said second compactor plate assembly and said elongated frame member;

a central mandrel mounted on one of said movable compactor plate assemblies;

a mating aperture in the other of said compactor plate assemblies adapted to slidably receive therein said mandrel during at least a portion of a tire compacting operation of the machine;

hydraulic power supply means operatively connected to said first and second hydraulic cylinder means;

control means for selectively applying hydraulic power to said first and second hydraulic cylinder means to move said first and second compactor plates together causing said central mandrel member to extend through said mating aperture and a number of tires to be compacted; said control means including stop means to limit said first and second compactor plates movement to a predetermined distance apart so as to compress a number of tires placed therebetween into a single dense bundle; and means for separating said compacted bundle and mandrel as said first and second compactor plates are retracted to adjacent said end plate members.

2. A machine for compressing and compacting according to claim 1 wherein said central mandrel is pivotally mounted on one compactor plate assembly for movement from axial alignment with said frame member and second compactor plate assembly to an elevated position forming an acute angle with said frame member axis.

3. A machine according to claim 2 wherein said one compactor plate assembly includes a bridge plate member mounted about said at least one tie bar member;

a base plate member pivotally and slidably mounted on said bridge plate member;

a compactor plate mounted on said base plate;

a stop member mounted on an end plate;

a cam member mounted on the bottom of said base plate;

so that when said compactor plate assembly is moved to the machine end plate position, said cam member will engage said stop member to slide and pivot said base plate member relative to said bridge plate member to elevate said mandrel.

4. A machine for compressing and compacting according to claim 1 including means for applying a plurality of bands about a number of tires compressed between said first and second compactor plates in said machine.

5. A machine for compressing and compacting according to claim 1 wherein said plurality of longitudinal tie bar members are hollow tubes extending from one end frame plate to the other, and said first and second hydraulic cylinder means each comprises:

an outer cylindrical sleeve member positioned about at least one of said hollow tie bar members for longitudinal sliding movement therealong;

an annular piston member fixed in said at least one hollow tie bar member substantially at the mid point between said end frame plates;

end cap and seal members formed in each end of said outer sleeve member to seal the ends thereof about said hollow tie bar while allowing sliding movement along said hollow tie bar to form a pair of opposed hydraulic cylinders with said fixed annular piston member; and means for selectively introducing hydraulic fluid into one of said hydraulic cylinders formed between said tie bar and sleeve to move said sleeve member relative to said piston member.

6. A machine for compressing and compacting according to claim 5 wherein each of said compactor plate assemblies are slidably mounted on a pair of hollow tie bar members; and said outer cylindrical sleeve member is positioned about at least one of each of said pair of tie bar members for each compactor plate assembly to form said first and second hydraulic cylinder means.

7. A machine for compressing and compacting according to claim 5 wherein said means for introducing hydraulic fluid includes:

a plug member fixed in the center of said hollow tie bar member;

a hole in the side wall of said hollow tie bar adjacent each side of said annular plug and piston member; and hydraulic hose means connecting the interior of said hollow tie bar at each end to a source of hydraulic fluid.

8. A machine according to claim 1 wherein:

said central mandrel has a length less than the distance between said first and second compactor plates when said compactor plates are positioned adjacent said end frame plates.

9. A machine according to claim 8 wherein said central mandrel length plus the length of a bundle of compressed tires is less than the distance between said first and second compactor plates when positioned adjacent said end frame plates.

10. A machine for compacting and banding together a large number of automobile tires into a compressed bundle which comprises:

an elongated frame member having a pair of end frame plates joined together by at least two pair of hollow tubes, an outer hollow sleeve slidably positioned about at least one tube of each pair of hollow tubes;

said hollow sleeves being closed at each end in fluid sealing relationship about the respective hollow tube;

a first compactor plate assembly mounted on one of said hollow sleeves for sliding movement along said frame member;

a second compactor plate assembly mounted on said other hollow sleeve for sliding movement along said frame member;

an annular piston member fixed on each hollow tube, having a hollow sleeve thereabout, to form a pair of hydraulic cylinders with said sleeves for movement of said plate assemblies; and hydraulic valve control means for selectively applying hydraulic pressure to one or the other of said pair of formed hydraulic cylinders to move said compactor plate assemblies toward and away from each other.

11. A machine according to claim 10 including an elongated mandrel having a rectangular cross-section and at least two longitudinal grooves, said mandrel being pivotally mounted on said first compactor plate assembly; and a corresponding aperture in said second compactor plate assembly to receive said mandrel therethrough when said compactor plates are moved together.

12. A machine according to claim 11 wherein said frame member has a length of fourteen feet; said mandrel has a length of nine feet and said compactor plate assemblies in the fully retracted position are twelve feet apart.

13. A machine according to claim 11 wherein said mandrel has a diameter smaller than the internal diameter of the tires to be compacted and large enough to maintain the tires in axial alignment during compaction.

* * * * *